US007967525B2

(12) United States Patent
Valle

(10) Patent No.: US 7,967,525 B2
(45) Date of Patent: Jun. 28, 2011

(54) CONCRETE ELEMENT WITH HIGH-VISIBILITY REFRACTING AND REFLECTING SURFACE

(75) Inventor: Fabio Valle, Rosa' (IT)

(73) Assignee: Valle Francesco S.R.L., Rosa' (VI) (IT)

( * ) Notice: Subject to any disclaimer, the term of this patent is extended or adjusted under 35 U.S.C. 154(b) by 0 days.

(21) Appl. No.: 12/281,986

(22) PCT Filed: Mar. 13, 2006

(86) PCT No.: PCT/IT2006/000149

§ 371 (c)(1),
(2), (4) Date: Oct. 25, 2008

(87) PCT Pub. No.: WO2007/105236

PCT Pub. Date: Sep. 20, 2007

(65) Prior Publication Data

US 2009/0060652 A1 Mar. 5, 2009

(51) Int. Cl.
*E01F 9/04* (2006.01)

(52) U.S. Cl. ..... 404/14; 359/547

(58) Field of Classification Search ..... 404/7, 14, 404/15, 34; 52/596; 359/547
See application file for complete search history.

(56) References Cited

U.S. PATENT DOCUMENTS

| | | | | |
|---|---|---|---|---|
| 4,129,673 | A * | 12/1978 | Eigenmann | 428/172 |
| 4,685,824 | A * | 8/1987 | Eigenmann | 404/9 |
| 4,772,155 | A * | 9/1988 | Dinitz | 404/7 |
| 5,051,023 | A * | 9/1991 | Yoshida et al. | 404/39 |
| 5,660,497 | A | 8/1997 | Kozak et al. | |
| 5,763,000 | A * | 6/1998 | Hedblom | 427/136 |
| 5,825,544 | A * | 10/1998 | Poisson | 359/551 |
| 5,928,761 | A * | 7/1999 | Hedblom et al. | 428/143 |
| 6,488,441 | B1 * | 12/2002 | Solime' | 404/42 |
| 6,665,986 | B1 * | 12/2003 | Kaplan | 52/102 |
| 6,939,077 | B1 * | 9/2005 | Hart | 404/39 |
| 7,316,519 | B2 * | 1/2008 | Ryman et al. | 404/22 |
| 2001/0010858 | A1 * | 8/2001 | Uchiya et al. | 428/147 |
| 2002/0006313 | A1 * | 1/2002 | Pas | 404/13 |

FOREIGN PATENT DOCUMENTS

| | | |
|---|---|---|
| DE | 10125862 | 12/2002 |
| EP | 0683403 | 11/1995 |
| JP | 08134813 | 5/1996 |
| JP | 10121408 | 5/1998 |
| WO | 9853145 | 11/1998 |

* cited by examiner

*Primary Examiner* — Gary S Hartmann
(74) *Attorney, Agent, or Firm* — Themis Law

(57) ABSTRACT

The invention relates to a concrete element for road marking and outdoor paving having a solid three-dimensional form, with a bottom surface resting on the ground and an upper surface exposed, wherein at least one housing or basin is provided on the upper surface for containing a layer of refracting mixture that includes in turn a plurality of spheres or microspheres mixed with a hardening support resin or adhesive.

10 Claims, 1 Drawing Sheet

CONCRETE ELEMENT WITH HIGH-VISIBILITY REFRACTING AND REFLECTING SURFACE

FIELD OF THE INVENTION

The present invention relates to concrete elements for outdoor paving and more particularly relates to a new concrete element, in particular for road marking and outdoor paving, with high-visibility refracting and reflecting upper surface. Currently road markings are commonly applied with white or yellow paint.

BACKGROUND OF THE INVENTION

Particular areas, such as zebra crossings, parking areas etc. are also marked with paint in other colors, such as blue and red.

The paints currently used for said road marking are subject to rapid deterioration, due above all to friction with the wheels of the vehicles and deposit of the fine dust generated and emitted by the vehicles running on the road.

Refracting paints are also known, used for example for road signs, which can be seen also in conditions of poor visibility and lighting, since they strongly reflect the light projected onto them, such as the light of vehicle headlights.

High-visibility refracting devices or signals are known, commonly used on public roads for signalling obstacles of any type, bends, roundabouts, road works, traffic dividers etc.

Often, however, traffic dividers, speed humps, edges of pavements etc. are not well signalled and motorists can inadvertently bump into them, with the risk of damaging part of the vehicle or the element itself. Furthermore, motorcycle and moped riders in particular risk falling off their vehicles and suffering serious injury.

The use of concrete blocks for paving outdoor surfaces, both public and private, such as roads, paths, courtyards, pavements, car parks etc. is known.

SUMMARY OF THE INVENTION

The subject of the present invention is a new type of concrete element, in particular for road marking and outdoor paving, with high-visibility refracting and reflecting upper surface The main object of the present invention is to increase the visibility of the road markings indicating roundabouts, curbs, etc.

A further object of the present invention is to indicate to road users the possible dangers and obstacles present on the road or in the immediate vicinity thereof, also in situations of poor visibility.

A further object of the present invention is for it to be used as a decorative element for avenues, gardens, squares, courtyards, etc.

These and other direct and complementary objects are achieved through the implementation of a concrete element according to the present invention, in particular for road marking and outdoor paving, with high-visibility refracting and reflecting upper surface that can be seen also in conditions of poor or zero lighting, when struck by artificial light.

The new element is made of concrete, with or without coloured pigments, and can have substantially any form.

For example, the new invention is embodied as a block with substantially parallelepiped central body and generically quadrangular cross section, with two generally longer longitudinal sides and two shorter transverse sides.

The lower horizontal surface or bottom surface of said element is substantially flat and constitutes the supporting base of the element on the foundation.

The upper surface, also preferably flat, is the exposed face of the element.

The upper surface of said element is partially sunken, i.e. delimited by perimeter edges raised by a few millimeters, for example approximately 5-10 mm, while the central area is lowered, in such a way as to form a basin.

After production of the concrete element as described, a new refracting mixture is cast inside said basin obtained on the upper surface.

Said refracting mixture consists, in its main components, of a hardening support resin or glue incorporating a plurality of spheres or microspheres made of a vitreous material, ceramic or plastic. Said resin or glue also acts as a binder for said spheres or microspheres.

Said resin contains, for example, also titanium dioxide, $TiO_2$, also called anatase, photocatalytic and hydrophilic, a self-cleaning substance which, if activated by sunlight, has the ability to collect the fine dust and PM10 emitted by the vehicles running on the road.

Said refracting mixture can also contain colored pigments that give the mixture the required colour, for example, in addition to white, also yellow, red, blue, black etc.

Said refracting mixture, when cast in said basin obtained in the element, is in a fluid, liquid or viscous state. The complete hardening of said mixture takes a few days. Said spheres or microspheres can be normal or oriented, i.e. partially coated with highly reflecting chromium-plated material, and their dimensions are in the order of one millimeter or one tenth of a millimeter.

Said spheres or microspheres have considerable refracting properties, i.e. they reflect even a minimum amount of light projected onto them, so that they are extremely bright even in conditions of poor lighting.

After casting of the refracting mixture, the upper surface of the new element is dusted with at least one further layer of said refracting spheres or microspheres, to increase the refracting properties of the upper surface.

The new element can be effectively applied to road surfaces, in particular to indicate traffic dividers, speed humps, zebra crossings, roundabouts, curbs, etc., and to make them visible to vehicles in transit, even at a considerable distance.

The new element is intended for use also for road markings such as the lines separating carriageways and lanes, stop and give way signs etc.

The new element is also intended for use in outdoor paving, both public and private, for delimiting flowerbeds, pavements, parking areas etc.

Said new elements can be used to increase visibility and facilitate the identification of no entry areas for vehicles, reserved areas etc.

The new element can also be used to create particular light effects on the paving of a courtyard, a square or other.

BRIEF DESCRIPTION OF THE SEVERAL VIEWS OF THE DRAWING

The attached drawing shows, as a non-limiting example, a practical embodiment of the invention.

DETAILED DESCRIPTION OF THE INVENTION

Figure 3:
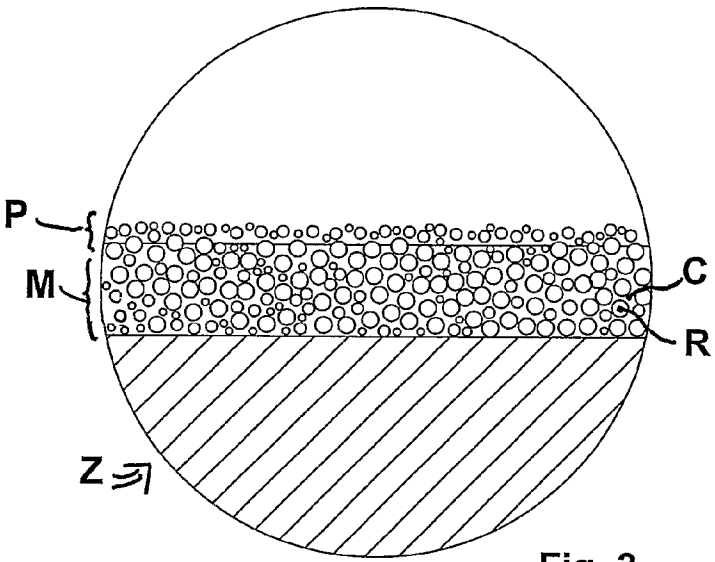
FIG. 3 shows a detail of the composition of the refracting mixture.
Figure 2:
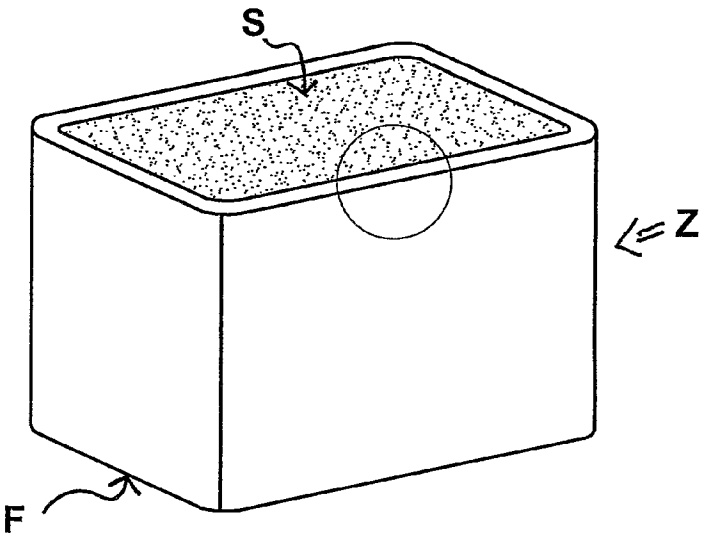
FIG. 2 shows a perspective view of the new element when completed.
Figure 1:
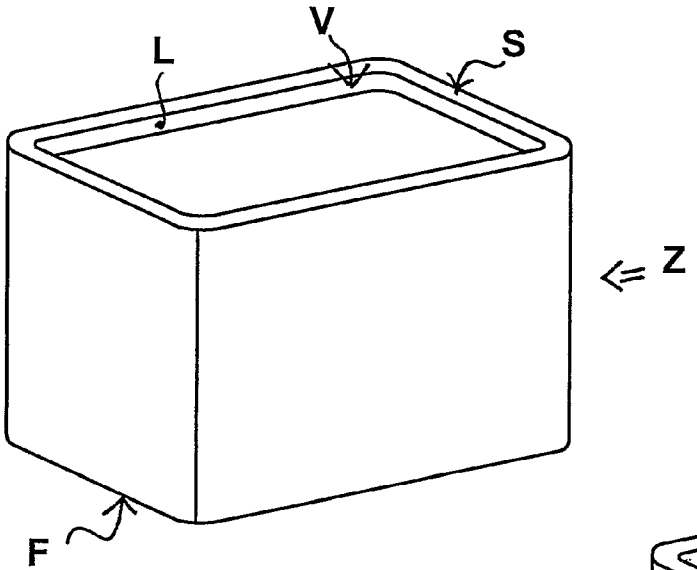
FIG. 1 shows a perspective view of the new concrete element in the first phase of production.

In its simplest embodiment, the new concrete element (Z) has a substantially parallelepiped central body, with a generically quadrangular cross section, with a bottom surface (F) resting on the foundation and an upper surface (S) constituting the exposed face of the paving.

On said upper surface (S) at least one housing, or basin (V) is obtained, suitable for containing a refracting mixture (M) consisting of refracting spheres or microspheres (R).

In particular, said basin (V) is delimited by perimeter edges (L) coinciding with the perimeter of said upper surface (S), and said perimeter edges (L) have thickness and height in the order of approximately 5-10 mm.

Inside said basin (V) delimited as described above, the refracting mixture (M) is cast, consisting of spheres or microspheres (R) mixed with a hardening support resin or glue (C) acting as a binder.

The upper surface (S) of the element and the upper surface of said casting of refracting mixture (M) are then dusted with at least one further layer (P) of said refracting spheres or microspheres (R).

Therefore, with reference to the preceding description and the attached drawing, the following claims are expressed.

The invention claimed is:

1. A concrete element for road marking and outdoor paving having a solid three-dimensional form, comprising:

a bottom surface configured to rest on a ground;

an upper surface having a housing or basin formed therein, the housing or basin being formed of concrete; and a layer of a mixture disposed in the housing or basin, the mixture being one or more of refracting or reflecting, the mixture comprising, a support resin or adhesive product different from the concrete, and a plurality of spheres or microspheres mixed within the support resin or adhesive product.

2. The concrete element of claim 1, further comprising at least one additional layer of the spheres or microspheres distributed on top of the layer of the mixture.

3. The concrete element of claim 2, wherein the additional layer is distributed by dusting.

4. The concrete element of claim 1, wherein the housing or basin is delimited by perimeter edges coinciding with an external perimeter of the upper surface.

5. The concrete element of claim 1, wherein the spheres or microspheres are vitreous, ceramic, or plastic.

6. The concrete element of claim 1, wherein the spheres or microspheres are at least partially coated with a highly reflecting material.

7. The concrete element of claim 1, wherein the resin or adhesive product comprises titanium dioxide.

8. The concrete element of claim 7, wherein the titanium dioxide is one or more of photocatalytic or hydrophilic.

9. The concrete element of claim 6, wherein the titanium dioxide is self-cleaning such to collect fine dust and PM10 upon light activation.

10. The concrete element of claim 1, wherein the resin or adhesive product contains one or more colored pigments.

* * * * *